United States Patent [19]

Hervert

[11] B 3,995,143

[45] Nov. 30, 1976

[54] MONOLITHIC HONEYCOMB FORM ELECTRIC HEATING DEVICE

[75] Inventor: George L. Hervert, Woodstock, Ill.

[73] Assignee: Universal Oil Products Company, Des Plaines, Ill.

[22] Filed: Oct. 8, 1974

[21] Appl. No.: 513,027

[44] Published under the second Trial Voluntary Protest Program on February 17, 1976 as document No. B 513,027.

[52] U.S. Cl. ..... 219/553; 219/374; 219/543; 252/477 R; 338/292; 427/249

[51] Int. Cl.² ..... H05B 3/10

[58] Field of Search ..... 219/300, 345, 369, 370, 219/374, 381, 543, 553; 252/421, 477 R, 502; 357/10; 338/223, 283, 308, 292, 309; 117/46 CB, 226, 46 CC; 161/68, 182; 118/49.5; 156/296; 13/22, 25, 31; 427/249

[56] References Cited

UNITED STATES PATENTS

| | | | |
|---|---|---|---|
| 2,767,289 | 10/1956 | Robinson | 338/223 |
| 3,032,635 | 5/1962 | Kraft | 338/283 X |
| 3,075,494 | 1/1963 | Toulmin, Jr. | 118/49.5 |
| 3,163,841 | 12/1964 | Willett | 338/292 |
| 3,172,774 | 3/1965 | Diefendorf | 427/249 |
| 3,345,448 | 10/1967 | Malkin | 13/25 |
| 3,502,596 | 3/1970 | Sowards | 252/477 |
| 3,651,386 | 3/1972 | Youtsey et al. | 357/10 |
| 3,825,460 | 7/1974 | Yoshikawa et al. | 156/296 |

FOREIGN PATENTS OR APPLICATIONS

| | | | |
|---|---|---|---|
| 512,667 | 10/1920 | France | 219/374 |
| 932,558 | 7/1963 | United Kingdom | 219/300 |
| 299,036 | 4/1971 | U.S.S.R. | 219/381 |

*Primary Examiner*—Volodymyr Y. Mayewsky
*Attorney, Agent, or Firm*—James R. Hoatson, Jr.; Philip T. Liggett; William H. Page, II

[57] ABSTRACT

A monolithic electrical resistance heater device is produced from placing a semiconducting coating of carbonaceous pyropolymer on the surfaces of a rigid "honeycomb type" of ceramic substrate and connecting electrodes to spaced, opposing portions thereof. The carbonaceous coating, or layer, is formed from heating an organic pyrolyzable substance in contact with the substrate surfaces at a temperature above about 400° C.

7 Claims, 6 Drawing Figures

Figure 5:
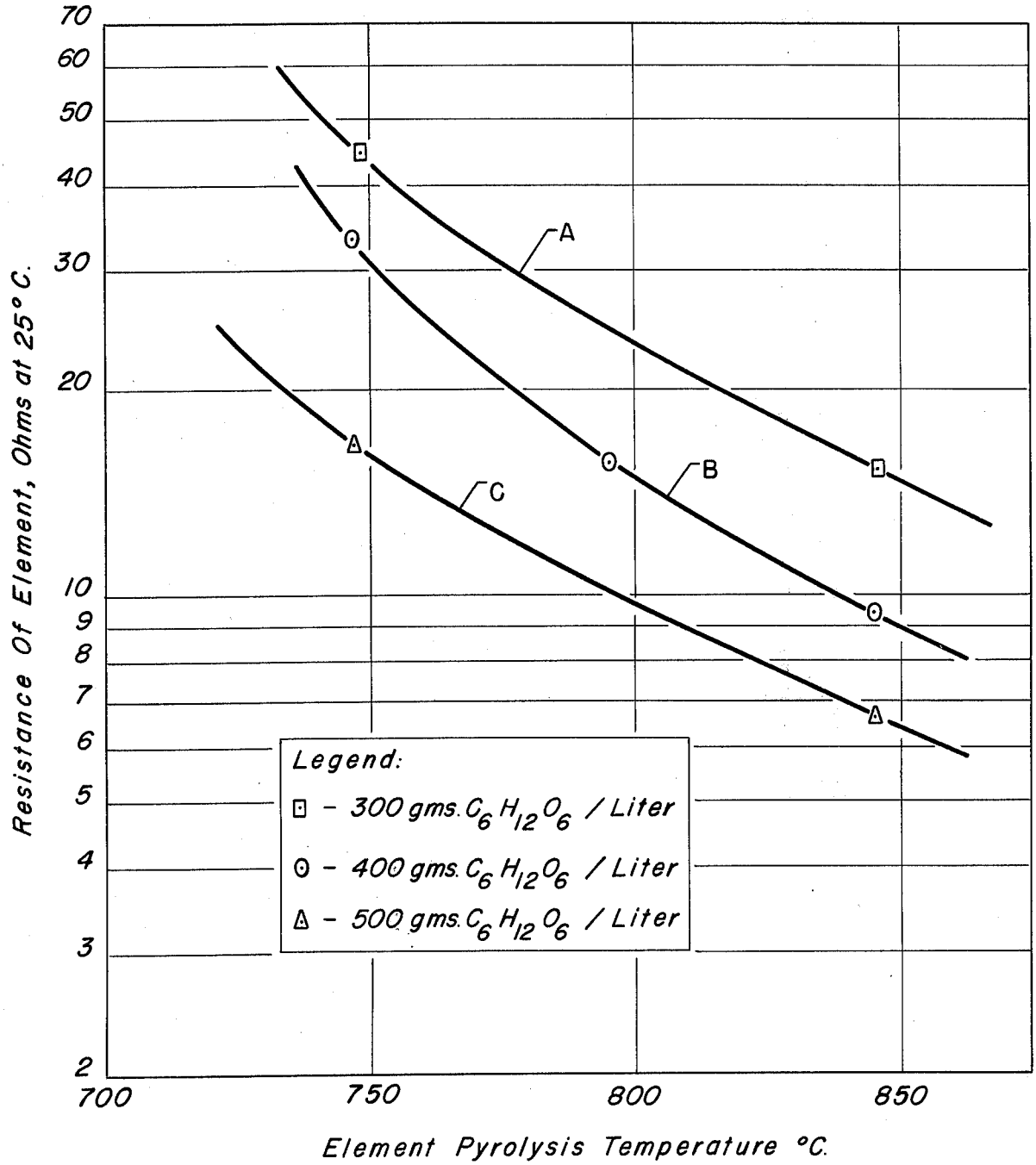

Figure 1
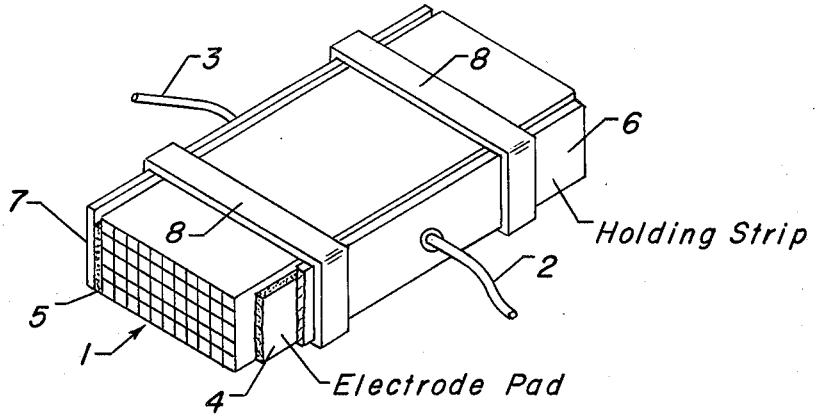
Figure 2
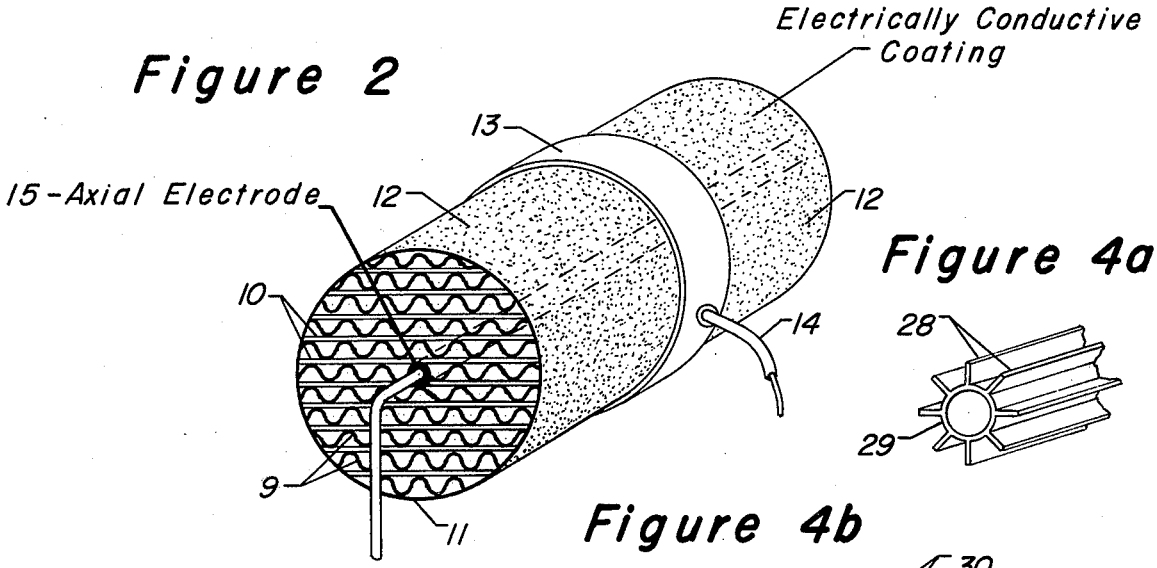
Figure 4a
Figure 4b
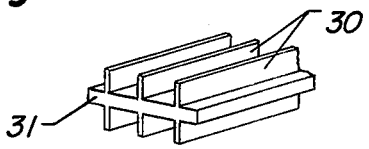
Figure 3
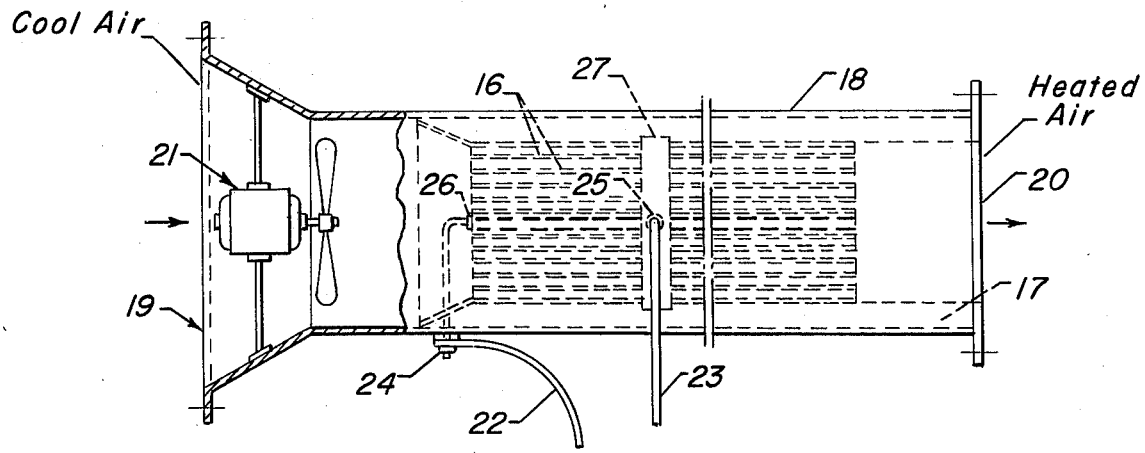

Effect Of Pyrolysis Temperature
On The Resistance
Of Monolithic Electric Heating Elements

MONOLITHIC HONEYCOMB FORM ELECTRIC HEATING DEVICE

This invention relates to novel forms of electrical resistance heaters and to the method for making rigid, monolithic types of semiconductive elements from the deposition of a carbonaceous pyropolymer on a non-conductive ceramic substrate having a large heat exchange surface area.

It is realized that there are many forms of resistance elements and many types of electrical resistance devices which have been developed and made for use in home and industry; however, none of the known devices have embodied the special carbonaceous pyropolymer of the present invention. Nor are there any known resistance elements which are coated surface ceramic honeycomb members. There are, of course, known types of small resistors which embody the depositions of carbon or graphite particles, carbon inks, etc., as part of the "thick film" technology. Also, there are certain types of resistors which comprise pressed powder mixes which, in turn, are made from carbon or other semiconductor materials.

The electrical conductivity of a material necessarily falls into one of three categories: conductors, semiconductors, or insulators. Conductors are those materials generally recognized to have a conductivity greater than about $10^2$ inverse ohm-centimeters, while insulators have a conductivity no greater than about $10^{-10}$ inverse ohm-centimeters. Materials with a conductivity between these limits are considered to be semiconducting materials. In this instance, the invention is directed to the use of one of the types of semiconductor material and in particular, to a semiconductor layer prepared in accordance with the teachings of U.S. Pat. No. 3,651,386.

Specifically, it may be considered to be a principal object of this invention to provide novel electric resistance elements for resistance heater devices which will be produced from depositing a semiconducting carbonaceous pyropolymer upon a rigid ceramic substrate. In particular, it is preferred to utilize high surface area members such as various ribbed or finned structure and especially the honeycomb types of ceramics where a multiplicity of open channels through the substrate will provide a large ratio of surface area per unit volume. Also, a coated, honeycomb type of electric heating element is of advantage in that it provides for a high surface area heat exchange surface that, in turn, can effect a rapid efficient heat transfer to a gaseous or liquid media that may be passed through the channels of the element.

In a broad aspect, the present invention provides a resistance heating element, which comprises, a non-conducting rigid substrate of primarily crystalline material, having an extended surface area structure; and a semiconducting coating, with a conductivity of from about $10^{-8}$ to about $10^2$ inverse ohm-centimeters, formed on said substrate from a layer of a carbonaceous pyropolymer in turn formed from heating an organic pyrolyzable substance in a primarily non-oxidizing atmosphere and in contact with the substrate surfaces at a temperature above about 400° c.

In another embodiment, the invention provides a resistance heating device, which comprises in combination: (a) a non-conducting rigid extended area substrate of primarily crystalline material, (b) a semiconducting coating, with a conductivity of from about $10^{-8}$ to about $10^2$ inverse ohm-centimeters on said substrate provided by a layer of a carbonaceous pyropolymer in turn formed from heating an organic pyrolyzable substance in a primarily non-oxidizing atmosphere and in contact with the substrate surfaces at a temperature above about 400°C., and (c) spaced electrodes to opposing portions of said coated substrate, whereby the semiconducting carbonaceous surfaces positioned between such electrodes can provide electrical resistance heating from electrical energy supply to the electrodes.

As will hereinafter be set forth more fully, there may be two methods of applying the carbonaceous pyropolymer layer to the substrate. In one instance, the substrate is dipped into the organic pyrolyzable substance and then dried and pyrolyzed in the presence of nitrogen or other generally non-oxidizing atmosphere. In another instance, the coating can be applied in a vapor phase operation where the organic pyrolyzable substance is entrained in a substantially non-oxidizing atmosphere at high temperature conditions so as to effect the continuous buildup of the resulting carbonaceous pyropolymer.

It is also within the scope of the present invention to provide varying sizes and shapes for the monolithic resistance element. The preferred honeycomb elements may be in a generally square or rectangular form with the electrodes connecting to two opposing side portions of the element whereby the resistance of the element will, in turn, provide a heating device when current is supplied to the electrodes. In another embodiment, the substrate may have a generally cylindrical form with longitudinal passageways extending parallel to the axis of the cylinder such that there may be air or other fluid flow passing through the multiplicity of parallel passageways. The electrodes to the coated semiconducting element may be provided from opposing side portions of the cylinder; however, in order to have uniform equal distances for current travel, it may be considered advantageous to have one electrode extending longitudinally and axially through the center of the element and an opposing electrode connecting to a band which encompasses the exterior of the cylindrical form element, such that current flow is radially through the element.

To insure good current distribution from the opposing electrodes and opposing surfaces, there can be a flash coating of stainless steel, or of silver or gold, on such surfaces. Alternatively, there may be used stainless steel felt pads, fine mesh pads, etc., to effect the desired current distribution.

With regard to physical characteristics, the semiconducting pyropolymer layer being provided on the substrate in accordance with the present invention will have a matte black color, with a surface area dependent generally upon the nature of the substrate. Structurally, the material is a precursor to graphite. The thermal conductivity of a coated element will be essentially that of the substrate. The electrical conductivity of the layer at room temperature is about $10^{-8}$ to about $10^2$ inverse ohm-centimeters. Actually, the electrical resistivity of the pyropolymer layer can be varied in a controlled manner over more than ten orders of magnitude, i.e., ranging from insulating ($10^{10}$ ohm-centimeters) to the value of graphite ($10^{-1}$ ohm-centimeters) at the low end of the range The greater the temperature and the greater the time period utilized during the vapor phase deposit of the pyropolymer layer, the higher the resulting conductivity, or the lower the resistivity. A thicker layer or greater quantity of resulting carbonaceous pyropolymer will also increase conductivity; however, for high resistance heating elements thin layers may be provided on the substrates.

In connection with the present invention, the refractory oxide substrate for the carbonaceous pyropolymer layer can be on a dense ceramic, such as alpha-alumina, or on material with a high surface area, such as one approaching gamma-alumina. Thus, the base material can be characterized as one having a surface area of from less than 1 to about 500 square meters per gram. However, for the coated, semiconductive element of this invention, there is required and utilized a rigid structurally strong inert crystalline ceramic material. For example, the carrier or support may be of sillimanite, magnesium silicates, silicates, zircon, petalite, spodumene, cordierite, aluminosilicates, mullite, and of mixtures of various of the aforesaid materials, such as zircon-mullite, etc. Certain of these types of materials are commercially available from such companies as E. I duPont de Nemours and Company; Corning Glass Works; and the American Lava Corporation, a subsidiary of 3M Company. The latter selling such substrate material as ThermaComb corrugated ceramics.

Examples of organic substances which may be pyrolyzed to form the pyropolymer on the surface of the refractory oxide support will include aliphatic hydrocarbons, cycloaliphatic hydrocarbons, aromatic hydrocarbons, aliphatic halogen derivatives, aliphatic oxygen derivatives, aliphatic sulfur derivatives, aliphatic nitrogen derivatives, heterocyclic compounds, organometallic compounds, etc. Some specific examples of these organic compounds which may be pyrolyzed will include ethane, propane, butane, pentane, ethylene, propylene, 1-butene, 2-butene, 1-pentene, 2-pentene, 1,3-butadiene, isoprene, cyclopentane, cyclohexane, methylcyclopentane, benzene, toluene, the isomeric xylenes, naphthalene, anthracene, chloromethane, bromomethane, chloroethane, bromoethane, chloropropane, bromopropane, iodopropane, chlorobutane, bromobutane, iodobutane, 1,2-dichloroethane, 1,2-dichloropropane, 1,2-dichlorobutane, ethyl alcohol, n-propyl alcohol, isopropyl alcohol, n-butyl alcohol, sec-butyl alcohol, t-butyl alcohol, glycol, glycerol, ethyl ether, isopropyl ether, butyl ether, ethyl mercaptan, n-propyl mercaptan, butyl mercaptan, methyl sulfide, ethyl sulfide, ethyl methyl sulfide, methyl propyl sulfide, dimethyl amine, diethyl amine, ethyl methyl amine, acetamide, propionamide, nitroethane, 1-nitropropane, 1-nitrobutane, acetonitrile, propionitrile, formic acid, acetic acid, oxalic acid, acrylic acid, formaldehyde, acid aldehyde, propionaldehyde, acetone, methyl ethyl ketone, methyl propyl ketone, ethyl propyl ketone, methyl formate, ethyl formate, ethyl acetate, benzyl chloride, phenol, o-cresol, benzyl alcohol, hydroquinone, resorcinol, catechol, anisole, phenetole, benzaldehyde, acetophenone, benzophenone, benzoquinone, benzoic acid, phenyl acetate acid, hydrocinnamic acid, furan, furfural, pyran, coumarin, indole, carbohydrate derivatives such as sugars, including dextrose, fructose, sucrose, starches, etc. It is to be understood that the aforementioned compounds are only representative of the class of compounds which may undergo pyropolymerization and that the present invention is not necessarily limited thereto.

As hereinbefore set forth the aforementioned organic compounds are dip coated on the substrate or are admixed with a carrier gas such as nitrogen or hydrogen, heated and thereafter passed over the refractory oxide substrate. The deposition of the pyropolymer on the surface of the base is effected at relatively high temperature ranging from about 400° to about 1100° C. and preferably in a range of from about 600° to about 950° C. Also, as heretofore noted, it is possible to govern the electrical properties of the semiconducting pyropolymeric layer by regulating the temperature and residence time during which the refractory oxide base is subjected to the treatment with the organic pyrolyzable substance, as well as by the weight or amount of pyropolymer deposited. The thus prepared semiconducting pyropolymeric inorganic refractory oxide material when recovered will possess a conductivity in the range of from about $10^{-8}$ to about $10^{2}$ inverse ohm-centimeter.

The specific improved forms of electrical resistance elements and heaters of the present invention may be better understood as to design and arrangement, as well as with regard to further advantages, by reference to the accompanying drawings and the following descriptions thereof.

FIG. 1 of the drawing is a diagrammatic view indicating a heating device utilizing a rectangular form of honeycomb element with a semiconducting layer formed thereon and electrodes connecting to the two opposing side portions of the element.

FIG. 2 of the drawing indicates diagrammatically a cylindrical form of semiconducting coated honeycomb element with an axial electrode and a circumferential electrode, with the latter in part utilizing a conductive metallic coating to encompass the entire external periphery of the coated cylindrical element of the device.

FIG. 3 of the drawing is an electrical heating apparatus having fan means to introduce an air stream through an internal honeycomb type of ceramic element which, in turn, has been made semiconductive with a coating of carbonaceous pyropolymer and is provided with current supplying electrodes in a manner similar to the arrangement of FIG. 2.

FIGS. 4*a* and 4*b* indicate special or modified forms of extended surface area substrates which incorporate a plurality of longitudinal ribs or fins.

FIG. 5 of the drawing shows, in graph form, the effects of varying coatings and varying pyrolysis temperatures in determining the resistance of the resulting carbonaceous pyropolymer layer on the substrate.

Referring now particularly to FIG. 1 of the drawing, there is shown a rectangular form of honeycomb element 1, which in accordance with the teachings of the present invention, will have been provided with a semiconducting layer of a carbonaceous pyropolymer on all of the surfaces of the interior passageways as well as on the external suface of the element. The present element indicates small substantially square open passageways through the length of the element; however, as heretofore noted, various types of honeycombs may be utilized which in turn may have varying sizes and configurations for the longitudinal open passageways formed in the substrate. The coated element will be black and semiconductive such that the transmission of electric current through the element will cause electrical resistance heating and resulting heat radiation from all of the surfaces of the element. Although not shown in the drawing, air or liquid streams can be caused to flow through the passageways of the element in order to provide for heat transfer into the particular fluid stream.

Various methods may be provided for attaching electrodes to the side portions of the element 1; however, in the present embodiment, there is indicated the use of electrical current conductive wires 2 and 3 carrying current to distributing electrode pads 4 and 5. Again, various types of electrode pad means may be utilized, as for example stainless steel gauze, or stainless settl wool. Preferably, a metal will be utilized which is not readily oxidizable nor corroded and which might cause an undesirable film or oxide material to encompass the electrode area. There is also indicated in the present drawing the utilization of holding bar means 6 and 7 along with tie band means 8 to insure the holding of the electrode pads 4 and 5 tightly against the coated side surface of the element 1.

Still other types of electrode means may be used, as for example. the utilization of precious metal monolayers from a paste or wash operation, or flash coatings of stainless steel, etc., to the particular current distributing side portions of the element such that the electric power supply wires may then be brought into contact with the metallic coatings through relatively small pad means or other suitable current distributing terminal means.

In FIG. 2 of the drawing there is indicated a cylindrical form of rigid ceramic substrate where internal wave-form members 9 and substantially flat members 10 will provide a multiplicity of longitudinal passageways through the element. There is also provided an encompassing deramic wall portion 11 to form the cylindrically shaped substrate. In accordance with the present invention, all surfaces of the substrate will be provided with the aforedescribed semiconductive carbonaceous pyropolymer coating. The encompassing ceramic surface of the present embodiment is, in turn, provided with an electrically conductive coating 12 which, as heretofore noted, may be a monolayer of a precious metal such as silver or gold, or may comprise a flash coating of stainless steel, or the like. It is the purpose of the metallic coating 12 to provide a continuous electrically conductive surface around the entire cylindrical form element and be able to carry current from conductive band means 13 and wire 14 to such outer surface. The opposing electrode, with respect to the peripheral surface, is provided by an axial electrode at 15 which will extend longitudinally through the entire length of the substrate. Such electrode may comprise a stainless steel bar, stainless steel wool or rolled gauze, or of other suitable electrode metal. Preferably, the axial electrode will be in a form that will provide good contact with the surfaces extending to the core of the substrate such that there will be good transfer of current from the electrode into the coated surfaces of the substrate at the core portion thereof.

In order to illustrate a somewhat more complete form of electrical heating apparatus, there is indicated in FIG. 3 of the drawing the utilization of a ceramic form of honeycomb substrate at 16, in turn, having the semiconductive layer of carbonaceous pyropolymer such that there may be electrical resistance heating provided from the substrate. The latter is, in turn, encompassed by insulating means 17 and an exterior housing 18 to provide a tubular form of heating apparatus with a cool air intake means 19 at one end and an outlet portion 20 for discharging air. There is also indicated the utilization of a motor-operated fan means at 21 to force cool air through the passageways of the honeycomb 16 whereby the latter can give up heat to the air stream being discharged by way of outlet 20. The electrical current supply for the device will be introduced by way of wires 22 and 23 which connect at the respective terminals 24 and 25. Terminal 24 is indicated as connecting to an axial electrode 26 while terminal 25 will connect to a current distributing band 27 and to an electrically conductive surface over the entire periphery of the element 16. Thus, as with the embodiment of FIG. 2, there will be radial current transmission through the cylindrical form of coated substrate and resistance heating to all of the coated surfaces whereby there may be heat transfer to the air stream passing through the multiplicity of passageways of the element.

The surface temperature of a particular element will, of course, depend upon the intensity of the electric currents being supplied to the electrodes. Preferably, the surface temperature will be maintained well below the oxidizing temperature of the carbonaceous pyropolymer and thus preferably below about 600° to 700°F. For example, element surface temperatures might well be in the 410° to 450°F. range and provide air flow temperatures from the element in the 400° to 440°F. range. In any particular heating device, the size of the element and the current supply to the electrodes therefor will be adjusted to provide a preferred range of temperature output to suit the particular heating conditions. Actually, large heaters utilizing house current could serve as room heating devices, while a small heater element operating from a car battery might well serve as an air heater for an internal combustion engine in order to improve an engine start-up for cold weather conditions.

Enumerable sizes and shapes of substrates may be employed forming a particular type of heater device and enumerable sizes and configurations may be obtained in connection with honeycomb forms of ceramics to provide a particular substrate. Heating elements and/or heating devices may be designed to accommodate various liquid flows and not be limited to the heating of an air stream which will be passed therethrough. Actually, it is believed that the carbonaceous pyropolymer layer provided on the present form of ceramic substrate will be inert to most all acid and base materials.

With particular reference to FIG. 4A of the drawing, there is merely indicated another form of extended area substrate which incorporates elongated fins 28 extending radially from a central rod or tube member 29. This type of substrate could well be coated and have electrodes to provide a heater device in the same manner as those shown and described as FIGS. 1 and 2. Also the embodiment of FIG. 4b, where there are fins or ribs 30 extending along and from a rectangular form core member 31, could be advantageously used as a substrate for coating and forming a resistance heating element.

The present types of heater devices will, of course, operate in a low temperature range as compared with usual resistance wire heating elements which normally operate in the red heat range such that there is less danger to persons or to materials for possible burning. From another aspect, there is an inherent safety feature in the use of the present monolithic heating elements in that when they are overloaded in an oxygen-containing atmosphere there will be a burning out of a portion of a layer at a much lower temperature than would occur with a resistance wire heating element so that it is, in effect, operating like a fuse, providing a burn-out and breakage without damage to wiring or other parts of an apparatus.

The preparation and resulting semiconductive elements embodied in the present invention may be further explained and understood by reference to the foregoing examples.

EXAMPLE II

In a more elaborate test procedure, nine test pieces of the same type of material set forth in Example I were prepared and coated in a similar manner. The specific coating conditions and the resulting resistances are set forth in the following Table A:

TABLE A

| The element in each instance is of a 2" by 2" by 1" thick size, with 196 channels per square inch, providing 44.8 square inches of heating surface per cubic inch of element. The element composition is cordierite, Type EX-20, supplied by Corning Glass Works Element No. | 1 | 2 | 3 | 4 | 5 | 6 | 7 | 8 | 9 |
|---|---|---|---|---|---|---|---|---|---|
| Weight, Calcined, gms. | 28.37 | 29.36 | 28.64 | 30.16 | 30.27 | 29.45 | 29.45 | 29.62 | 30.42 |
| Impregnating Solution | | | | | | | | | |
| $C_6H_{12}O_6$ (Dextrose) gms/L solution | 300 | 300 | 400 | 400 | 400 | 500 | 500 | 500 | 500 |
| $C_6H_{12}O_6$ Wt. % | 27.0 | 27.0 | 34.9 | 34.9 | 34.9 | 42.3 | 42.3 | 42.3 | 42.3 |
| Density 25° C, gms/ml | 1.110 | 1.110 | 1.147 | 1.147 | 1.147 | 1.183 | 1.183 | 1.183 | 1.183 |
| Impregnating Conditions | | | | | | | | | |
| $C_6H_{12}O_6$ Solution Element, ml | 200 | 200 | 200 | 200 | 200 | 200 | 200 | 200 | 200 |
| Temp.°C. | 25 | 25 | 25 | 25 | 25 | 25 | 25 | 25 | 25 |
| Duration, Min. | 5 | 5 | 5 | 5 | 5 | 5 | 5 | 5 | 5 |
| Wet Weight, q | 37.92 | 38.80 | 36.76 | 38.89 | 39.77 | 38.02 | 38.20 | 38.10 | 38.93 |
| $C_6H_{12}O_6$ Solution Pickup, gms. | 9.55 | 9.44 | 8.12 | 8.73 | 9.50 | 8.57 | 8.56 | 8.48 | 8.51 |
| $C_6H_{12}O_6$ Solution Pickup, Wt.% | 33.7 | 32.2 | 28.4 | 28.9 | 31.4 | 29.1 | 28.9 | 28.6 | 28.0 |
| Drying Conditions | | | | | | | | | |
| Temp. °C. | 90–120 | 90–120 | 90–120 | 90–120 | 90–120 | 90–120 | 90–120 | 90–120 | 90–12( |
| Duration, Hours | 2 | 2 | 2 | 2 | 2 | 2 | 2 | 2 | 2 |
| Dry Weight, gms. | 31.03 | 32.03 | 31.58 | 33.37 | 33.63 | 33.17 | 33.16 | 33.31 | 34.73 |
| Pyrolysis Conditions | | | | | | | | | |
| Temp. °C. | 748 | 846 | 747 | 795 | 845 | 845 | 845 | 845 | 747 |
| Duration, Hours | 1.5 | 1.5 | 1.5 | 1.5 | 1.5 | 1.5 | 1.5 | 1.5 | 1.5 |
| Monolithic Element | | | | | | | | | |
| Finished Weight, gms. | 28.90 | 29.90 | 29.20 | 30.77 | 30.93 | 30.19 | 30.39 | 30.36 | 31.16 |
| Pyropolymer, gms/Element | 0.53 | 0.54 | 0.56 | 0.61 | 0.66 | 0.74 | 0.75 | 0.74 | 0.74 |
| Pyropolymer Content, Wt. % | 1.83 | 1.81 | 1.92 | 1.98 | 2.13 | 2.45 | 2.47 | 2.44 | 2.37 |
| Electrical Resistance, Ohms at 25°C. | 45 | 15.4 | 33.5 | 15.8 | 9.6 | 7.3 | 6.5 | 6.3 | 16.8 |

EXAMPLE I

In one test procedure a test substrate piece, 2 inches by 2 inches by 1 inch thick, was made from a honeycomb element that had 196 channels per square inch (14 per linear inch, each way) and supplied by the Corning Glass Works. The material was an extruded crystalline silica-magnesia-alumina material, essentially cordierite, that is also known as a Type EX-20, providing an exposed surface of about 44.8 square inch of surface per cubic inch of honeycomb element.

The substrate was dipped into an aqueous dextrose solution (containing about 500 grams of dextrose per liter) at room temperature for a 5-minute period and then oven dried in air at 90°–120° C. for a 2-hour period. The dried, dextrose-impregnated honeycomb substrate was then pyrolyzed within a muffle furnace while in the presence of nitrogen for a 1.5-hour period.

The resulting element had a 16 ohm resistance, with electrodes attached at the opposite ends of the element, and provided a 400° C. (752° F.) surface temperature with the application of 110 Volts across the terminals. This temperature is, of course, rather high for a normal or continuous operation for this type of material such that lower voltages are preferably used, as for example a lower voltage which would provide an element temperature of the order of 410° F. and an average air temperature through the element of the order of 400° F.

From the electrical resistance values which result for the various coated elements, it will be apparent that those elements which have had a higher temperature pyrolysis, as for example above 845° C., there is greater conductivity and less resistance as compared to those which were pyrolyzed at lower temperature conditions. It is also to be noted that an element which had a larger or greater quantity of dextrose applied to the substrate surface during the pyrolysis step resulted in somewhat greater conductivity, or less resistance, in the resulting carbonaceous pyropolymer layer.

Actually, as perhaps better shown in FIG. 5 of the drawing, there is illustrated the effect of a greater pyrolysis temperature as well as the effects of varying solutions to which the substrate is subjected. Specifically, with respect to FIG. 5, there is shown a line A resulting from measuring the resistance of substrate elements which were coated with a 300 gram/liter dextrose solution prior to being subjected to pyrolysis at the particular conditions indicated, namely at about 750° C. and at about 845° C. In another instance, line B results from determining the resistances of coated substrates which were subjected to 400 grams of dextrose/liter prior to pyrolysis at temperatures of about 750° C., about 795° C., and about 845° C. In still another instance, line C results from measuring the resistances of the carbonaceous pyropolymer layers on substrates that were coated with 500 grams of dextrose/liter under pyrolysis conditions of about 750° C. and at about 845° C.

From a study of curves or lines A, B and C, it will be evident that, in each instance, the higher temperature pyrolysis conditions will provide greater conductivity, or less resistance, for a particular coated substrate while conversely, lower temperature pyrolysis conditions result in higher resistivity. It will be further apparent that a greater amount of organic pyrolyzable substance, such as the dextrose, being in contact with the substrate during the pyrolysis period will result in greater conductivity, or lower resistances, for the resulting coated elements. Although not indicated in the graph presented by FIG. 5, it has been found that the pyrolysis time period does, to some extent, have an effect upon resistance and that greater time periods for carrying out the pyrolysis operation will lessen resistivity. However, the effect of time is in no way directly proportional to resulting conductivity and greatly extended time periods are of no particular advantage. Typically, pyrolysis time periods of from 1½ to 2 hours are sufficient.

For the present elements, there has been set forth and described the direct formation of a carbonaceous pyropolymer on the plurality of surfaces of the extended area ceramic substrate. However, it is to be noted that a honeycomb, or other extended area ceramic monolith may be first coated with a slurry of alumina, or other refractory metal oxide material, and the coating baked or calcined onto the ceramic surface as a first step of a two-stage coating procedure. The oxide coated substrate is then subjected to the dipping or vaporizing coating procedure to effect the deposition of the organic pyrolyzable material, as well as subjected to the heating in the non-oxidizing atmosphere in order to provide the desired carbonaceous pyropolymer layer.

Also, although not shown in any of the drawings, it may be of advantage to provide a suitable protective coating over the carbonaceous pyropolymer layer to preclude errosion and undesired further oxidation or corrosion aspects. For example, a layer of a suitable non-conductive, heat stable "plastic" material may be used to advantage to provide the desired protective coating, with such material being an epoxy resin, fluoroplastics, phenol-formaldehyde, polyesters, polyaryl sulfone, polysulfone, polyphenylene sulfides, polyimides, polysilicone, or the like, or multilayer combinations of any of the foregoing.

I claim as my invention:

1. A resistance heating device, which comprises in combination:

a. a non-conducting rigid substrate of primarily crystalline ceramic material having a multiplicity of channels;

b. a semiconducting carbonaceous pyropolymer coating, with a conductivity of from about $10^{-8}$ to about $10^{2}$ inverse ohm-centimeters, deposited directly on the surfaces of said substrate by heating an organic pyrolyzable substance in a primarily non-oxidizing atmosphere and in contact with the substrate surfaces at a temperature above about 400° C.; and c. spaced electrodes connected to opposing portions of said coated substrate, whereby the semiconducting carbonaceous surfaces positioned between such electrodes can provide electrical resistance heating from electrical energy supplied to the electrodes.

2. The resistance heating device of claim 1 further characterized in that said spaced electrodes connected to opposing portions of said coated substrate comprise conductive metal pads, with each pad substantially covering one of said opposing portions of said substrate and current carrying wires connective with said metal pads to provide the electrical energy to the device.

3. The resistance heating device of claim 2 still further characterized in that said metal pads are of stainless steel mesh.

4. The resistance heating device of claim 1 further characterized in that said spaced electrodes comprise in part a conductive metallic coating covering said opposing portions of the substrate and current supplying wire means thereto to provide electrical energy to the device.

5. The resistance heating device of claim 4 still further characterized in that said conductive metallic coating is selected from the group consisting of stainless steel, silver and gold.

6. The resistance heating device of claim 1 further characterized in that said rigid substrate is a rectangular form honeycomb structure providing straight side portions to which said spaced electrodes are attached.

7. The resistance heating device of claim 1 further characterized in that said substrate is of a cylindrical form honeycomb structure and one of said spaced electrodes is positioned axially through the center portion of said coated substrate to be in contact with the central portions of said cylindrical form substrate and the second electrode is in contact with the entire outside periphery of said cylindrical substrate.

* * * * *